US007437775B2

(12) United States Patent
Reynolds

(10) Patent No.: US 7,437,775 B2
(45) Date of Patent: Oct. 21, 2008

(54) BODY FORM-FITTING RAINWEAR

(76) Inventor: Eric M. Reynolds, 838 North St., Boulder, CO (US) 80304

( * ) Notice: Subject to any disclaimer, the term of this patent is extended or adjusted under 35 U.S.C. 154(b) by 0 days.

(21) Appl. No.: 11/622,569

(22) Filed: Jan. 12, 2007

(65) Prior Publication Data

US 2007/0113315 A1 May 24, 2007

Related U.S. Application Data

(63) Continuation of application No. 10/316,343, filed on Dec. 11, 2002, now Pat. No. 7,162,746.

(60) Provisional application No. 60/340,686, filed on Dec. 12, 2001.

(51) Int. Cl.
*A41D 31/02* (2006.01)
*A41D 3/04* (2006.01)

(52) U.S. Cl. ..... 2/87; 2/82; 2/69

(58) Field of Classification Search ..... 2/455–457, 2/51, 69, 69.5, 79, 78.1, 904, 901, 97, 114, 2/171, 202, 84, 200.1, 167, 400, 402, 403, 2/406, 227, 238, 239, 275, DIG. 1, DIG. 5, 2/87, 85, 82, 93, 106, 108, 113, 115, 243.1, 2/272; 428/304.4, 311.11, 315.9, 913, 308.4, 428/315.5; 442/77, 80, 85, 86, 88, 82
See application file for complete search history.

(56) References Cited

U.S. PATENT DOCUMENTS

| | | | | |
|---|---|---|---|---|
| 34,890 | A | 4/1862 | Knight | |
| 3,870,593 | A | 3/1975 | Elton et al. | |
| 4,194,041 | A * | 3/1980 | Gore et al. | 442/289 |
| 4,430,759 | A | 2/1984 | Jackrel | |
| 4,443,511 | A | 4/1984 | Worden et al. | |
| 4,454,191 | A * | 6/1984 | von Blucher et al. | 442/224 |
| 4,469,744 | A | 9/1984 | Grot et al. | |
| 4,507,880 | A | 4/1985 | Ohashi | |
| 4,518,650 | A | 5/1985 | Grot et al. | |
| 4,545,841 | A | 10/1985 | Jackrel | |
| 4,550,446 | A | 11/1985 | Herman | |
| 4,599,810 | A | 7/1986 | Sacre | |
| 4,613,544 | A | 9/1986 | Burleigh | |
| 4,819,345 | A | 4/1989 | Mulcahy et al. | |
| 4,829,683 | A | 5/1989 | Chikamori | |

(Continued)

OTHER PUBLICATIONS

"W.L. Gore & Associates Unveils Next Generation Of Windstopper N2S™ Fabric Collection For Lightweight And Midweight Garments", GORE-TEX and WINDSTOPER Fabrics 2001 Press Release, Sep. 10, 2001, p. 1.

(Continued)

*Primary Examiner*—Amy B Vanatta
(74) *Attorney, Agent, or Firm*—Lathrop & Gage LC

(57) ABSTRACT

A body form-fitting rainwear is provided. In the rainwear, a first waterproof layer comprises a polymer material treated with an oleophobic composition to form an air permeable polymer material. The first waterproof layer couples to a first fabric layer. The first fabric layer faces the body and couples to a first side of the first waterproof layer. The first waterproof layer and first fabric layer are formable about a human body and are constructed and arranged to accommodate one or more human appendages. The rainwear may for example form a shirt, pant, underwear, long underwear, hat, hood or one-piece body suit.

18 Claims, 6 Drawing Sheets

U.S. PATENT DOCUMENTS 4,833,026 A 5/1989 Kausch
4,856,207 A 8/1989 Datson
4,899,465 A 2/1990 Bleimhofer et al.
4,918,981 A 4/1990 Gore
4,932,078 A 6/1990 Jones et al.
5,022,109 A 6/1991 Pekar
5,026,591 A 6/1991 Henn et al.
5,158,636 A 10/1992 Groitzsch et al.
5,236,769 A * 8/1993 Paire ..... 428/196
5,244,716 A * 9/1993 Thornton et al. ..... 428/198
5,260,360 A * 11/1993 Mrozinski et al. ..... 524/95
5,289,644 A 3/1994 Driskill et al.
5,342,434 A * 8/1994 Wu ..... 96/13
5,364,678 A * 11/1994 Lumb et al. ..... 428/96
5,402,540 A 4/1995 Williams
5,409,761 A 4/1995 Langley
5,426,869 A 6/1995 Gore et al.
5,480,455 A * 1/1996 Norvell ..... 623/36
5,505,011 A 4/1996 Bleimhofer
5,526,532 A * 6/1996 Willard ..... 2/69
5,526,584 A 6/1996 Bleimhofer et al.
5,539,072 A * 7/1996 Wu ..... 526/304
5,593,754 A * 1/1997 Blauer et al. ..... 428/131
5,596,770 A 1/1997 Kunesh
5,628,127 A 5/1997 Notzold
5,640,718 A * 6/1997 Aldridge ..... 2/81
5,642,573 A 7/1997 Brown
5,685,091 A 11/1997 Yalamanchili
5,689,903 A 11/1997 Aumann
5,690,949 A * 11/1997 Weimer et al. ..... 424/402
5,700,544 A * 12/1997 Goodwin et al. ..... 428/76
5,732,413 A 3/1998 Williams
5,732,480 A 3/1998 Notzold
5,786,058 A * 7/1998 Megchelsen et al. ..... 428/57
5,804,011 A 9/1998 Dutta et al.
5,832,539 A 11/1998 Williams
5,925,441 A 7/1999 Blauer et al.
5,933,984 A 8/1999 Carlson et al.
5,964,047 A 10/1999 Covatch
5,981,019 A 11/1999 Goodwin et al.
5,981,038 A * 11/1999 Weimer et al. ..... 428/198
5,992,054 A 11/1999 Rauch
6,018,819 A * 2/2000 King et al. ..... 2/69
6,040,251 A 3/2000 Caldwell
6,074,738 A * 6/2000 von Fragstein et al. ... 428/315.9
6,092,305 A 7/2000 Troy et al.
6,235,662 B1 * 5/2001 Zehnder ..... 442/223
6,336,221 B1 * 1/2002 Blauer et al. ..... 2/87
2001/0008672 A1 * 7/2001 Norvell et al. ..... 428/90

OTHER PUBLICATIONS

"Transition Fleece One layer does the work of three", http://www.mountainhardwear.com/clothes/transition.html, Sep. 10, 2001, p. 1.
"Vapor Barrier: Benefits of Vapor Barrier", http://www.warmlite.com/vb.htm, Sep. 10, 2001, pp. 1-3.
"Vapor Barrier Clothing: Stephenson no Sweat Shirt", http://www.warmlite.com/vb_shirt.htm, Sep. 10, 2001, pp. 1-2.
"Warmlite Triple Bags", http://www.warmlite.com/Bags.htm, Sep. 10, 2001, pp. 1-5.
"Ponchos and Rain Jackets: Related Subject:Rain Gear", http://www.warmlite.com/ponchos.htm, Sep. 10, 2001, p. 1.
"Better Than the Skin You're in", advertisement, 3 pages, undated.
Related U.S. Appl. No. 10/316,343, Restriction Requirement, mailed Sep. 27, 2004.
Related U.S. Appl. No. 10/316,343, Response to Restriction Requirement of Sep. 27, 2004.
Related U.S. Appl. No. 10/316,343, Office Action, mailed Jun. 2, 2005.
Related U.S. Appl. No. 10/316,343, Response to Office Action of Jun. 2, 2005.
Related U.S. Appl. No. 10/316,343, Notice of Non-Responsive Reply, mailed Feb. 22, 2005.
Related U.S. Appl. No. 10/316,343, Response to Notice of Non-Responsive Reply of Feb. 22, 2005.
Related U.S. Appl. No. 10/316,343, Office Action, mailed Feb. 22, 2006.
Related U.S. Appl. No. 10/316,343, Response to Office Action of Feb. 22, 2006.
Related U.S. Appl. No. 10/316,343, Notice of Allowance, mailed Sep.7, 2006.

* cited by examiner

BODY FORM-FITTING RAINWEAR

RELATED APPLICATIONS

This application is a continuation application of U.S. application Ser. No. 10/316,343, filed Dec. 11, 2002, now U.S. Pat. No. 7,162,746 which claimed priority to U.S. Application No. 60/340,686, filed Dec. 12, 2001, each of which is incorporated herein by reference.

BACKGROUND

The prior art is familiar with various forms of rainwear. However, much of this rainwear is uncomfortable because the rainwear does not efficiently transmit water vapor away from the body. Prior art rainwear can also be bulky and uncomfortable to wear, as it is generally the outer most layer of a multi-layer system that provides the rain protection.

SUMMARY

As used herein, moisture vapor transmission rate (MVTR) means the amount of moisture vapor transmission through a fabric as measured by the JIS-1099-B2 method.

As used herein, waterproof penetration or resistance in "psi" means that the material withstands water penetration to at least the stated pounds per square inch as measured by the Mullen test method.

As used herein, "hydrophilic" means a material that absorbs water.

As used herein, "hydrophobic" means a material that will not absorb water.

As used herein, "substantially hydrophobic" means that a material will gain no more than 10% in water weight when fully saturated by water.

As used herein, expanded polytetrafluoroethylene with a hydrophobic oleophobic treatment may be manufactured according to GORE-TEX® XCR® 3-LAYER Fabric and BHA eVENT™ Fabric technology known in the art.

As used herein, "form fit" means a material that fits close to the body but does not restrict freedom of movement. Preferably, a "form fit" material also allows other garments to fit over it comfortably.

As used herein, "skin tight" means a clothing material that substantially contacts human skin, throughout the full internal area of the material, when worn by a user.

As used herein, "adhesive dots" are formed of glue which couples two layers of material together.

As used herein, "termination" implies a clothing item with only one aperture, like a glove. Once an appendage (e.g., a hand) enters terminated clothing, like a glove, then that appendage may only leave the clothing, generally, back through the same aperture. "Non-terminated" implies clothing such as pants, long underwear, underwear, one-piece body suits, and shirts, where several apertures permit use of the clothing around the human appendages and without termination.

In one aspect, non-terminated, multi-aperture body form-fitting rainwear is provided. In the rainwear, a first waterproof moisture vapor permeable hydrophobic layer couples to a first fabric layer. The first fabric layer faces the body and couples to a first side of the first waterproof moisture vapor permeable hydrophobic layer. The first waterproof moisture vapor permeable hydrophobic layer and first fabric layer are formable about a human body and are constructed and arranged with multiple apertures to accommodate, without termination, two or more human appendages. This aspect may for example form a shirt, pant, underwear, long underwear and a one-piece body suit.

In accord with one aspect, the inner hydrophobic fabric layer pulls sweat off the body by wicking action to spread over a large surface area in order to facilitate a rapid transfer of moisture through the layers. This function may be accomplished by surface treatments with the fiber providing capillary action. Polyester is one such hydrophobic material and an ideal synthetic.

In one aspect, the waterproof hydrophobic layer resists water penetration to at least 2 psi, and preferably at least 10 psi.

In one preferred aspect, the body form-fitting rainwear includes two key features as compared to the prior art:

1. The rain barrier is close to the body and underneath other layers that provide insulation, wind, and water repellent functions.
2. The rainwear is not based upon a "wet system" technology, known in the art. Wet systems utilize a hydrophilic component in the waterproof layer to aid in the movement of water through the material. By having a hydrophilic layer in the system, liquid water is retained in the material. This water is undesirable in close proximity to the body as liquid water conducts heat away from the body at a very high rate, increasing heat loss.

However, hydrophilic layers may also be used. In one aspect, non-terminated, multi-aperture body form-fitting rainwear is provided. In the rainwear, a first waterproof moisture vapor permeable hydrophilic layer couples to a first fabric layer. The first fabric layer faces the body and couples to a first side of the first waterproof moisture vapor permeable hydrophilic layer. The first waterproof moisture vapor permeable hydrophilic layer and first fabric layer are formable about a human body and are constructed and arranged with multiple apertures to accommodate, without termination, two or more human appendages. This aspect may for example form a shirt, pant, underwear, long underwear and a one-piece body suit.

In accord with one aspect, the inner hydrophilic fabric layer pulls sweat off the body by wicking action to spread over a large surface area in order to facilitate a rapid transfer of moisture through the layers. This function may be accomplished by surface treatments with the fiber providing capillary action.

In another aspect, the layer adjacent human skin is a "bicomponent" knit. The bicomponent knit "wicks" sweat off the body, and the moisture is then pulled to the second side of the knit where it spreads over a larger surface area adjacent the waterproof layer. The spreading occurs because (a) there is a stronger wicking finish on the outer knit side (so there is a differential wicking factor between the two yarns), and/or (b) the first part of the bicomponent is comprised of yarns with a certain number of filaments and a second part of the bicomponent is comprised of yarns with a greater number of filaments which have a much higher surface area (hence a stronger capillary action).

In another aspect, the rainwear includes an outer hydrophobic fabric layer coupled to a second side of the waterproof hydrophilic layer for protecting the first waterproof hydrophilic layer and the first fabric layer. The outer fabric layer does not interfere with the apertures and is generally selected from the group consisting of woven, knit, or non-woven material(s). The outer hydrophobic fabric is ideally non-wicking but it should have a strongly water repellant finish on the hydrophobic layer. It may, for example, be polyester or nylon treated with water repellant chemicals (such as fluorocarbons or silicones) so that penetrating rain generally stays off of the membrane layer (i.e., the hydrophilic layer).

The rainwear may be extended, in another aspect, by two additional layers. A second waterproof moisture vapor permeable hydrophobic (or hydrophilic) layer has a first side coupled to a second side of the first waterproof hydrophilic layer. A second fabric layer couples to a second side of the second waterproof moisture vapor permeable hydrophobic (or hydrophilic) layer. The first and second waterproof moisture vapor permeable hydrophobic (or hydrophilic) layers and the first and second fabric layers are formable about a human body and are constructed and arranged with multiple apertures to accommodate, without termination, two or more human appendages.

In still another aspect, the coupling of these four layers includes utilizing new and novel waterproof seams, as described herein.

The rainwear disclosed herein provides several advantages over existing rainwear. Since the waterproof layer is next to the body, it is protected from the wear and tear of use. There is less chance of the waterproof layer losing its protection because it most commonly will function as an "internal" layer, which is more easily protected from the abrasions, punctures, rips, and tears experienced by outer clothing. Moreover, the waterproof/breathable barrier is placed in close proximity to the heat engine of the body where the driving forces that power the transmission of water vapor are most powerful. Accordingly, once the water vapor has been pushed through the close-to-body waterproof layer, that vapor will not go back into contact with the body and contribute to conductive or evaporative heat loss. Additionally, a garment construction in a body form-fitting, or skin tight, design uses less fabric and is hence less expensive to produce. The rainwear also does not generally include pockets, flaps or decorative styling features. As well, an internal rain garment as described herein will allow for greater freedom of movement than traditional rainwear used as the outer layer in a clothing layering system.

DETAILED DESCRIPTION OF THE DRAWINGS

Figure 1A:
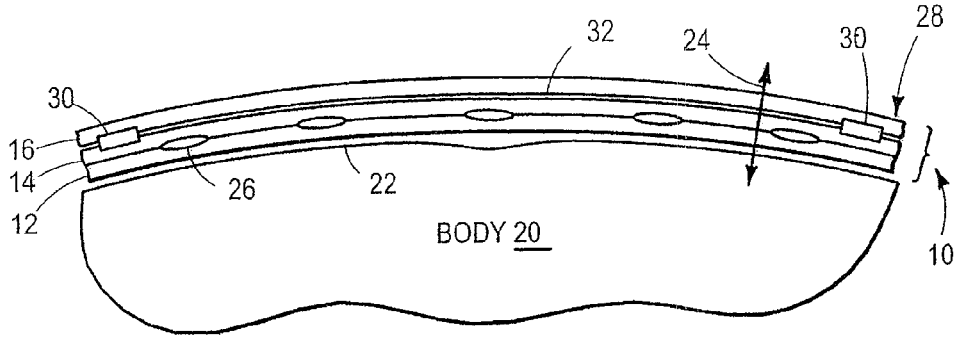
FIG. 1A illustrates one two-layer rainwear laminate coupled with an outer layer, according to an embodiment.

FIG. 1A shows one rainwear 10 that protects a human body 20 from rain. Rainwear 10 is shown with three-layers: layer 12 is an inner fabric layer adjacent to the skin of body 20, layer 14 is a waterproof moisture vapor permeable hydrophobic layer, and layer 16 is optional and represents an outer fabric layer. Rainwear 10 is preferably "form fit" to the body. That is, if rainwear 10 is "skin tight", the spacing 22 between body 20 and rainwear 10 is essentially zero millimeters. If rainwear 10 is loosely fitted to body 20, then spacing 22 may be up to about twenty-five millimeters. Those skilled in the art will appreciate that gap 22 is illustrative and that gap 22 may vary throughout in interfacing between rainwear 10 and body 20. Specifically, rainwear 10 may contact body 20 in some locations even though a gap exists, on average, for the whole interface between body 20 and rainwear 10. When rainwear 10 is skin tight, it essentially eliminates gaps 22, 32.

Generally, rainwear 10 has a MVTR of 5,000 or more, to provide comfort. Layer 14 may, for example, be made from expanded polytetrafluoroethylene with a hydrophobic air permeable oleophobic treatment, or from expanded polytetrafluoroethylene with a hydrophilic oleophobic treatment. Layer 14 may also be a polyurethane, polyolefin, or a waterproof polymer layer. Layer 14 absorbs less than 30%, and preferably less than 10% in water weight when fully saturated by water. In one embodiment, layer 14 absorbs less than 1%, and preferably less than 0.001% in water weight when fully saturated by water. Layer 12 may be a knitted (e.g., a plaited knit), woven or non-woven fabric; preferably, layer 12 is a bicomponent knit. Layer 16 may, for example, be a nylon, polyester, acrylic, polypropylene, polyolefin or synthetic fiber material.

Along direction 24, layer 14 has a thickness generally less than 2 mm. Layer 12 may couple to layer 14 by glue or adhesive dots 26, as shown. Outer layer 16 is preferably sewn to layer 14, using sewing material 30, at the perimeter 28 of rainwear 10. Only a small air gap 32 generally exists between layer 14 and layer 16. Gap 32 is, for example, generally less than twenty millimeters, and preferably less than two millimeters. Layer 16 may alternatively be in direct contact with layer 14. Those skilled in the art will appreciate that gap 32 is illustrative, and that gap 32 may vary throughout in interfacing between layer 14 and layer 16. Specifically, outer layer 16 may also contact layer 14 in some locations even though a gap 32 exists, on average, for the whole interface between layer 14 and layer 16. Outer layer 16 may also be designed for direct contact with layer 14, thereby eliminating gap 32.

It should be obvious to those skilled in the art that rainwear 10 "surrounds" the body as "near-to-body" clothing and that FIG. 1A is simplified for illustrative purposes. Moreover, elements of the drawings may not be drawn to scale.

Figure 1B:
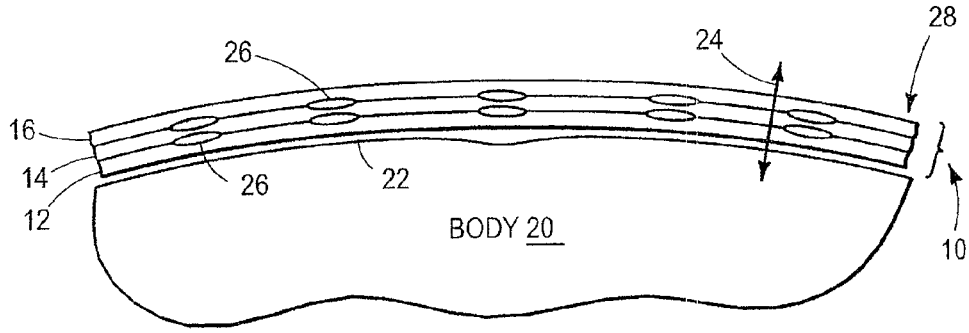
FIG. 1B illustrates one three-layer rainwear laminate, according to an embodiment.

In one embodiment, and as shown in FIG. 1B, outer layer 16 also couples with layer 14 through a plurality of glue or adhesive dots 26, similar to those used to couple layers 12 and 14, thereby eliminating gap 32. Such rainwear may be called a "three-layer laminate" herein.

In one embodiment, layer 14 of FIGS. 1A, 1B is instead a waterproof moisture vapor permeable hydrophilic layer.

Figure 2A:
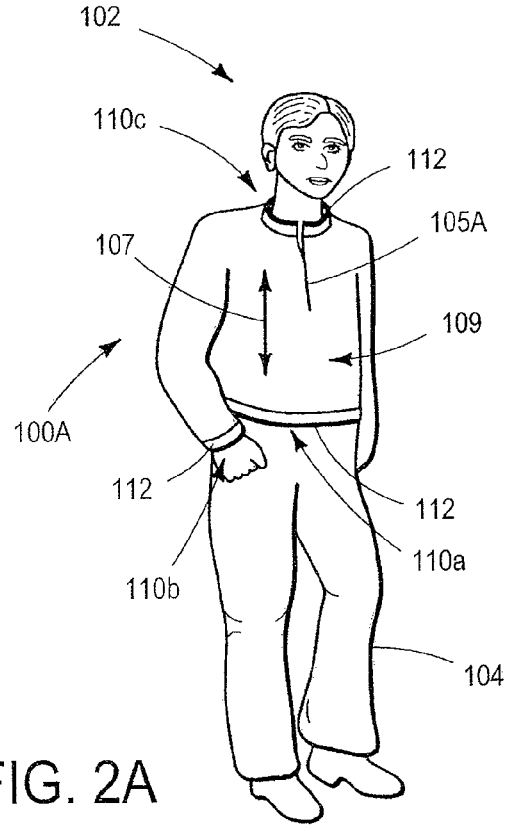
FIG. 2A illustrates one exemplary non-terminated, multi-apertured article of rainwear, as displayed on a person.

FIG. 2A shows one rainwear item 100A in the form of a long sleeve shirt, worn on a user 102. User 102 may wear item 100A on his body 104 such that item 100A interfaces with body 104 like rainwear 10 to body 20, FIGS. 1A, 1B. Item 100A is "non-terminated" so that it forms around body 104 with apertures 110*a*, 110*b*, 110*c* accommodating, respectively, the torso, hands and head of body 104. Preferably, item 100A includes waterproof seam tape 112 at all or most of the seams joining the fabric pieces, in accord with the teachings herein. Rainwear item 100A is shown with an optional zipper 105A that partially extends along a direction 107 of the torso 109 of user 102.

Figure 2B:
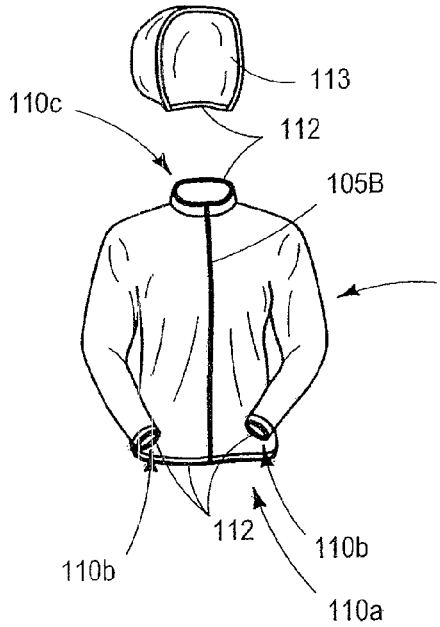
FIG. 2B illustrates another exemplary non-terminated, multi-apertured article of rainwear, and a terminated hood.

FIG. 2B shows another rainwear 100B similar to rainwear 100A. Rainwear 100B has an optional zipper 105B extending the full length of rainwear 100B. A hood 113 may be worn by user 102, for example. Hood 113 may be formed of the two-layer or three-layer laminates of FIGS. 1A, 1B, and may further include seam tape 112. Hood 113 may permanently attach to rainwear 100B or optionally attach with snaps or zippers, as a matter of design choice.

Rainwear 100A and 100B of FIG. 2A and FIG. 2B, respectively, exemplify rainwear garments formable about a body 104 by the laminates described herein. In the following figures, as in FIGS. 1A, 1B, such laminates are shown in cross-sectional views and in partial constructions about the human body for purposes of illustration. Those skilled in the art will appreciate that the laminates may be formed fully or partially about the body and into a desired garment as a matter of design choice.

Figure 3:
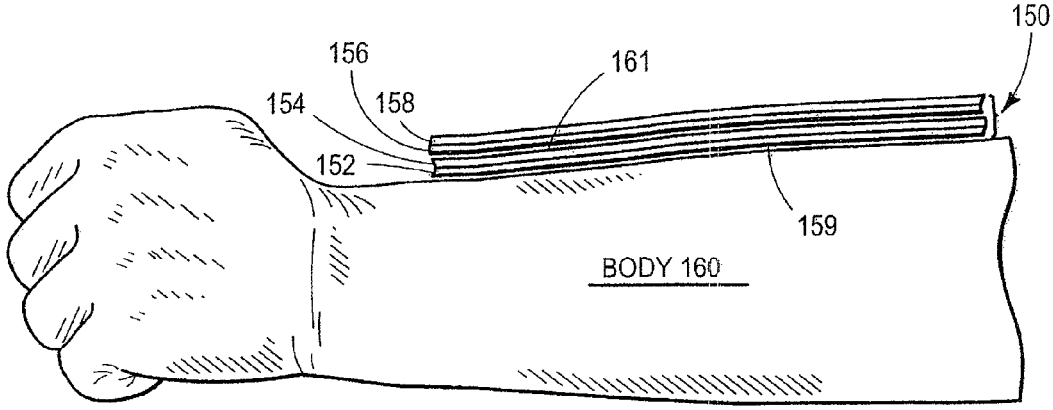
FIG. 3 illustrates a four-layer rainwear laminate, according to an embodiment.

FIG. 3 shows a four-layer laminate rainwear 150 for protecting a human body 160. Laminate rainwear 150 has layers 152, 154, 156, 158. Layers 152 and 154 are the same as layers 12, 14, respectively, of FIGS. 1A, 1B. Layers 156, 158 are also similar to layers 12, 14 of FIGS. 1A, 1B. Specifically, layer 156 is a second waterproof moisture vapor permeable hydrophobic layer and layer 158 is a second fabric layer coupled to layer 156. Layers 156, 158 maybe coupled together as in layers 12, 14 of FIGS. 1A, 1B. Rainwear laminate 150 may also include an outer layer 16 (not shown in FIG. 3) as a matter of design choice. As above, a gap 159 may exist between body 160 and layer 152. A gap 161 may further exist between layers 154 and 156, and between layer 158 and the outer layer (e.g., layer 16, if applied to layer 158). Laminate 152, 154 is for example coupled to laminate 156, 158 by a sewing material (e.g., sewing material 30, FIG. 1A).

In one embodiment, one or both of layers 154, 156 of FIG. 3 is instead a waterproof moisture vapor permeable hydrophilic layer.

It should be apparent to those skilled in the art that rainwear 150 is shown in a cross-sectional view, for purposes of illustration, and that rainwear 150 forms about body 160 at the desired region to protect that body region from rain.

Figure 4:
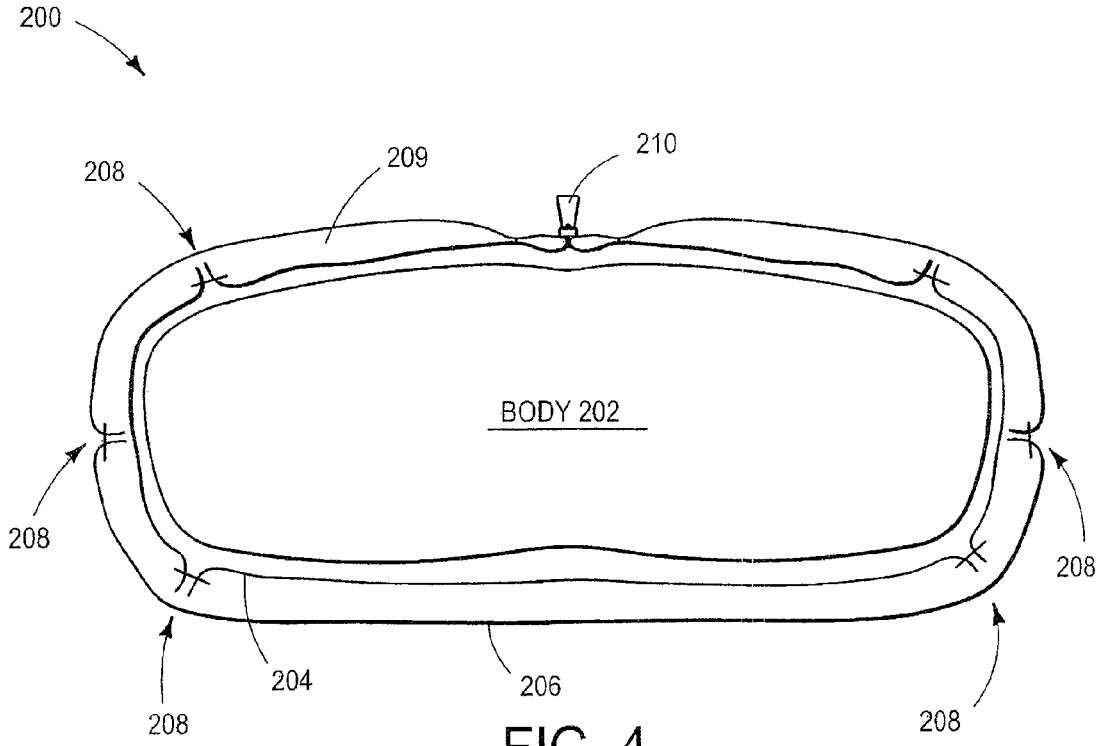
FIG. 4 shows one exemplary rainwear utilizing the four-layer laminate of FIG. 3.

FIG. 4 shows another rainwear 200 about a body 202. Rainwear 200 is made from layers 152, 154 (shown as a single layer 204) and layers 156, 158 (shown as a single layer 206). Rainwear 200 has offset seams 208 between layers 204, 206, as shown, to prevent moisture from directly penetrating any one layer 206, 208. A zipper 210 may be used to combine layers 204, 206 as a useful garment, e.g., a pant, shirt, or long underwear. Rainwear 200 may allow construction of a waterproof garment without seam tape 112, FIGS. 2A, 2B, as a matter of design choice. It should be apparent that FIG. 4 shows a cross-sectional view of rainwear 200 to clearly illustrate layers 204, 206, and that zipper 210 operates perpendicular to the plane of the paper.

Figure 5A:
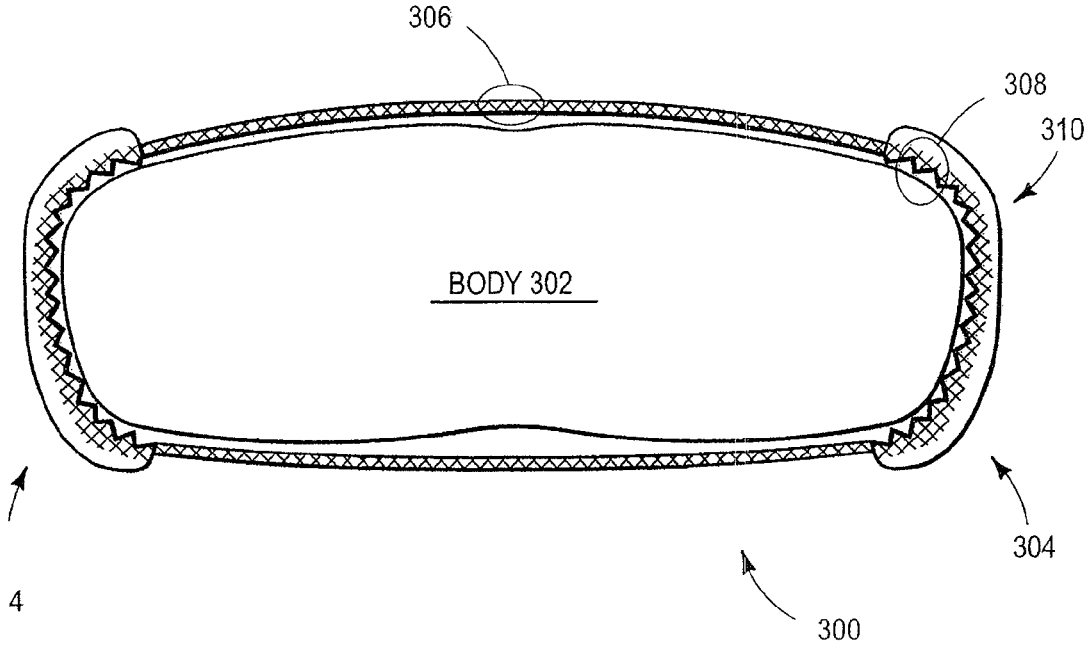
FIG. 5A shows one exemplary body form-fitting rainwear construction.

FIG. 5A shows another rainwear 300 (in cross-sectional view to illustrate layers of rainwear 300) about a body 302. Rainwear 300 has two side panels 304 that stretch about body 302 in creating a snug fit to body 302. Except for panels 304, rainwear 300 is made from a three-layer laminate 306, which has little or no stretching capability. Laminate 306 may include layers 12 and 14, FIGS. 1A, 1B, as the inner-most two layers (with layer 12 closest to body 302), and an outer layer (e.g., layer 16). Panels 304, on the other hand, are made from either a two-layer or three-layer laminate 308 and an outer stretch knit 310. The inner-most two layers of laminate 308 are for example layers 12, 14, FIGS. 1A, 1B, again with layer 12 adjacent body 302. If a third layer exists in laminate 308, it is for example outer layer 16. Stretch material 310 may be either knit or woven material that pulls the entire rainwear 300 to body 302 when worn. In one embodiment, layer 308 is the same material laminate as layer 306, but it is shown "gathering" or "puckering" in response to stretch layer 310 disposed over layer 308. Laminate 308 differs from laminate 306 at least in that it is loosely fit to body 302.

Figure 5B:
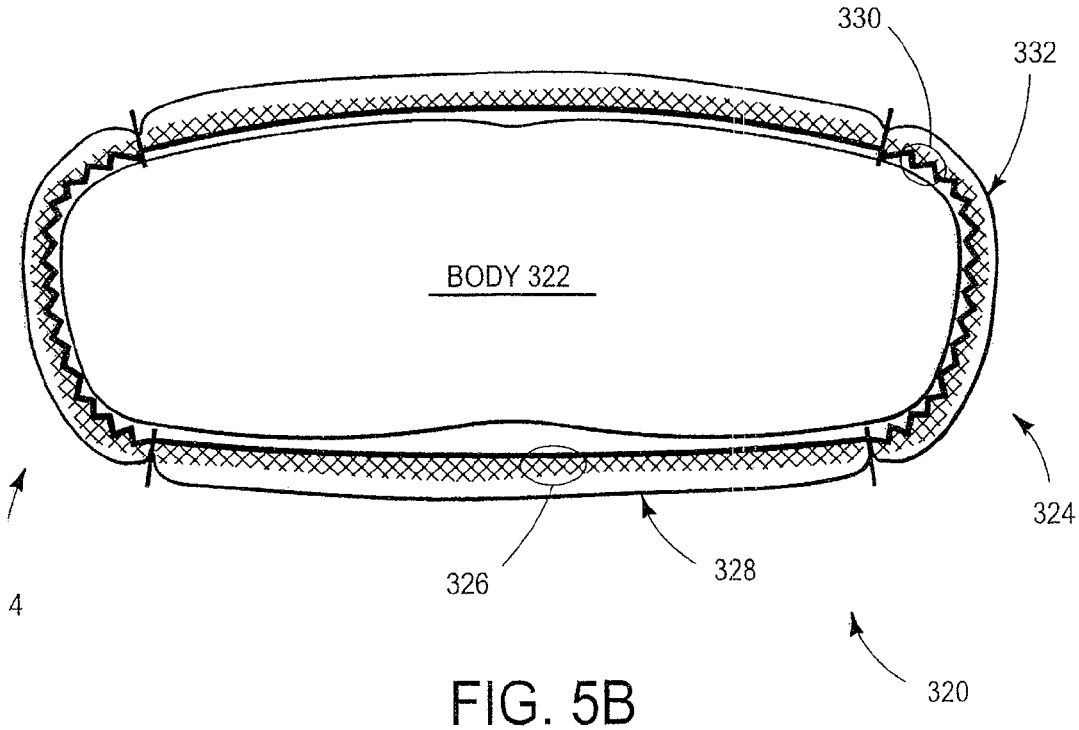
FIG. 5B shows one exemplary body form-fitting rainwear construction.

FIG. 5B shows another rainwear 320 about a body 322. Rainwear 320 has two side panels 324 that stretch about body 322 in creating a snug fit to body 322. Except for panels 324, rainwear 320 is made from a two-layer laminate 326, which has little or no stretching capability. Laminate 326 may include layers 12 and 14, FIGS. 1A, 1B, with layer 12 closest to body 322. An outer layer 328 covers laminate 326; layer 328 is either a stretch knit or a stretch woven layer, which may or may not have stretch properties. Panels 324, on the other hand, are made from either a two-layer or three-layer laminate 330 and an outer stretch knit 332. The inner-most two layers of laminate 330 are for example layers 12, 14, FIGS. 1A, 1B, again with layer 12 adjacent body 322. If a third layer exists in laminate 330, it is for example outer layer 16. Stretch knit 332 is a woven material that pulls the entire rainwear 320 to body 322 when worn. Laminate 330 differs from laminate 326 at least in that it is loosely fit to body 322.

Figure 6:
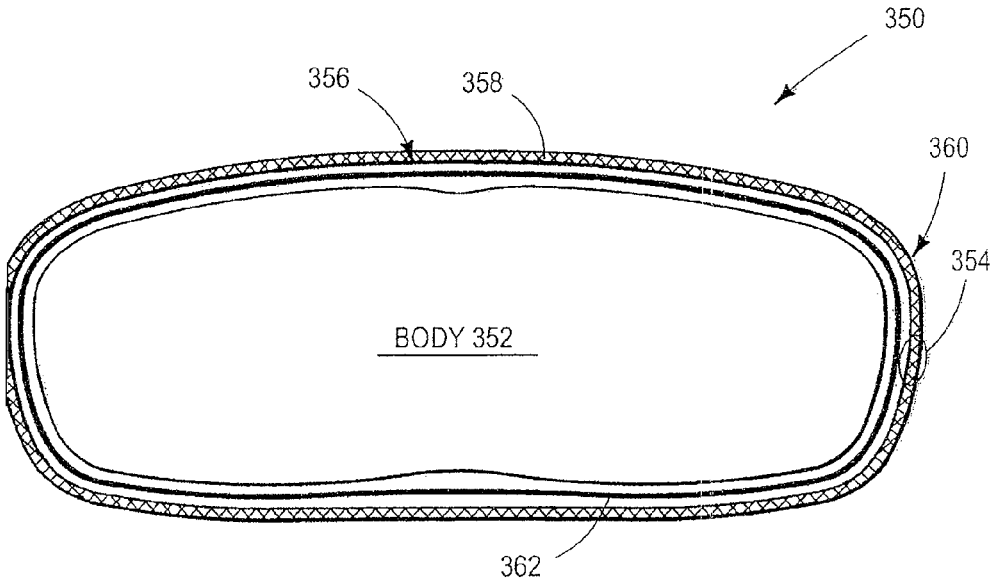
FIG. 6 shows one exemplary body form-fitting rainwear construction.

FIG. 6 shows one rainwear 350 about a body 352. Rainwear 350 includes a three-layer laminate 354. Laminate 354 may include an inner knit layer 356, which has little or no stretching capability, an inner waterproof, breathable layer 358, and an outer knit 360, also having little or no stretching capability. Layer 358 is, for example, layer 14 of FIGS. 1A, 1B. Laminate 354 conforms closely to body 352. If laminate 354 has some stretching capability, then it may conform tightly to body 352, e.g., it may be body form-fitting. Inner knit layer 356 may have a smooth sliding texture such as a tricot knit; or it may be a bicomponent knit with some texture. Layer 360 may also be a bicomponent knit.

Optionally, rainwear 350 is configured within an inner underwear layer 362. Layer 362 couples with layer 356 through techniques such as described with reference to FIGS. 1A, 1B. Layer 362 may for example be a bicomponent knit with or without wicking capability.

Figure 7:
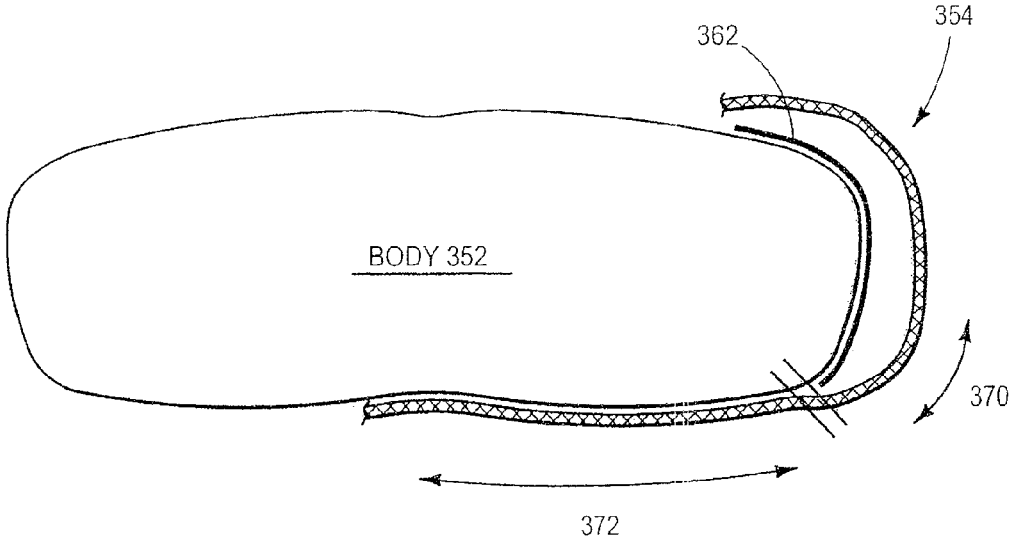
FIG. 7 shows the rainwear of FIG. 6 in snug or loosely fitting configurations.

FIG. 7 illustrates how laminate 354 may fit snugly or loosely about body 352. With underwear layer 362, laminate 354 may fit loosely to body 352, as illustrated by region 370 of FIG. 7. Without underwear layer 362, laminate 354 may fit snugly to body 352, as illustrated by region 372 of FIG. 7. Laminate 354 is not shown completely around body 352 for purposes of illustration.

Figure 8:
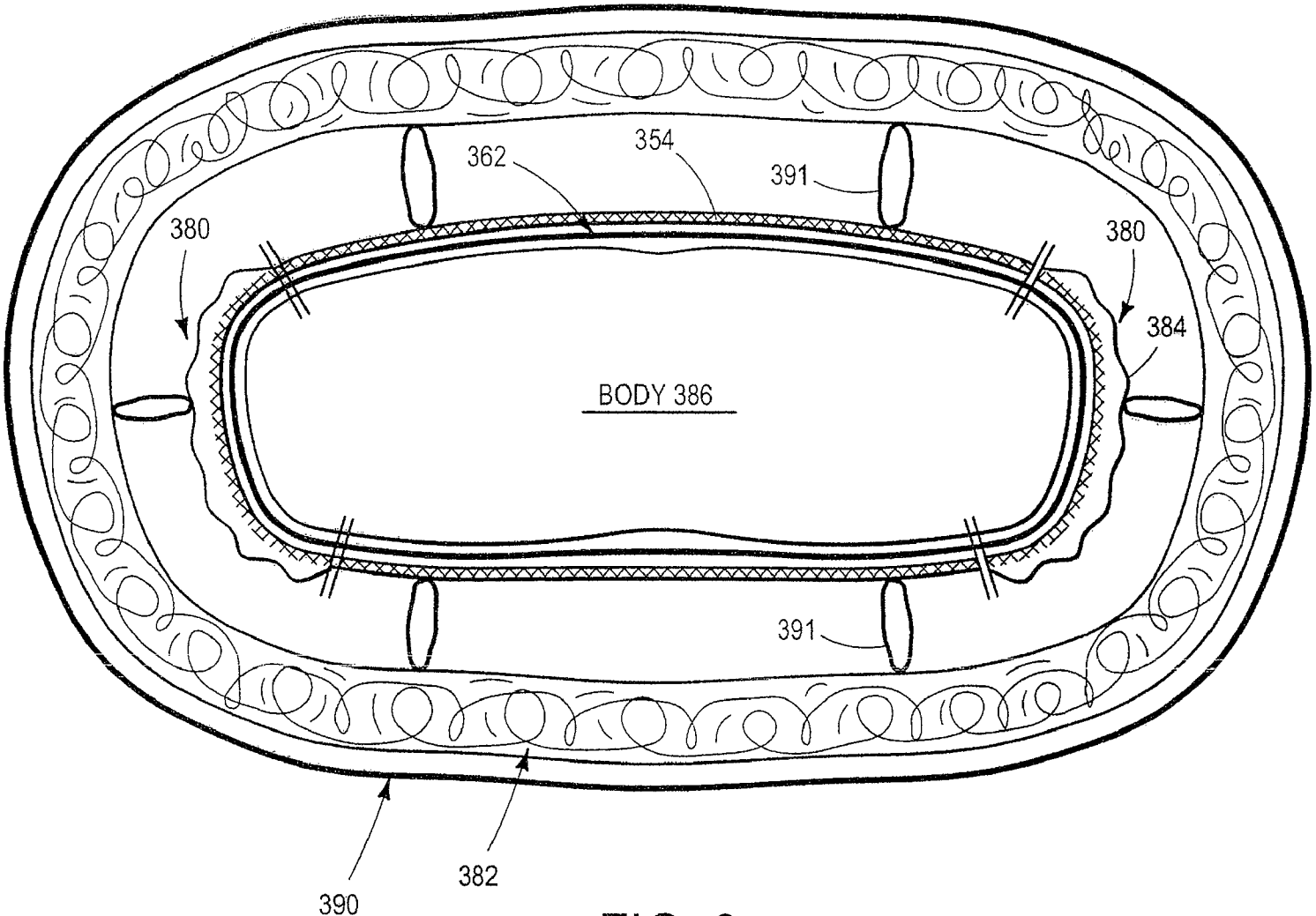
FIG. 8 shows one exemplary body form-fitting rainwear construction.

In one embodiment, laminate 354 is constructed with a side panel 380 and, optionally, with an outer insulation layer 382, as shown in FIG. 8. Laminate 354 and panel 380 together form body-form fitting rainwear about body 386. Side panel 380 may be made of layers of laminate 354 and an outer stretch knit 384, to pull the rainwear to body 386. Insulation layer 382 loosely couples (e.g., with threading 391) to laminate 354 and panel 380, and may for example be sweater, fleece, and/or down insulating material of one or more layers. A water repellant layer 390 (or waterproof woven shell 390) may further cover insulation layer 382. Accordingly, laminate 354, panel 380 and insulation layer 382 (and/or layer 390) form a warm, comfortable clothing with body form-fitting rainwear properties described herein.

Figure 9:
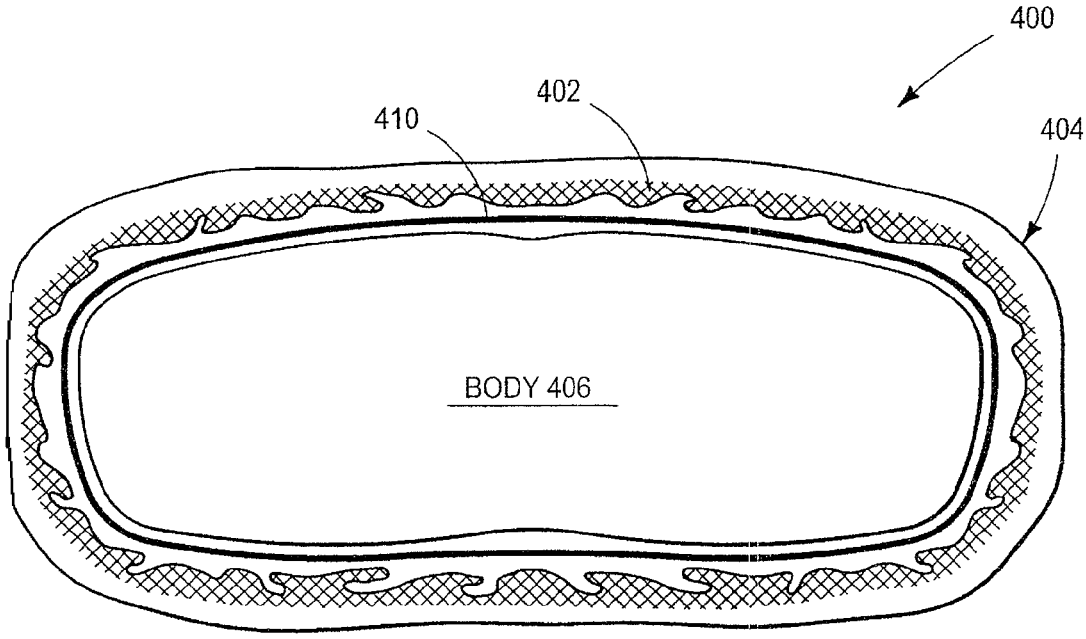
FIG. 9 shows one exemplary body form-fitting rainwear construction.

FIG. 9 shows one body form fitting rainwear 400 that includes a two-layer laminate 402 and an outer stretch knit or woven layer 404 to conform laminate 402 to body 406. Laminate 402 may for example be layers 12, 14 of FIGS. 1A, 1B, with layer 12 closest to body 406. Laminate 402 has little or no stretching capability (and, by itself would fit loosely over body 406) so that layer 404 forces laminate 402 against body 406 as body form-fitting rainwear 400. Optionally, rainwear 400 may include an underwear layer 410, which may be, for example, a bicomponent knit with or without wicking capability. Rainwear 400 has advantages in that it provides a snug-fit to body 406 but is less expensive to manufacture than existing rainwear because inexpensive layer 404 is separate from laminate 402.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present devices and methods, which, as a matter of language, might be said to fall there between.

What is claimed is:

1. Body form-fitting rainwear, comprising:

a first waterproof layer comprising a polymer material treated with an oleophobic composition, wherein the treated polymer material is air permeable, the first waterproof layer coupled to a first fabric layer, the first waterproof layer and the first fabric layer having, in combination, a moisture vapor transmission rate (MVTR) greater than or equal to 5000 grams per square meter per day as measured by test method JIS-1099-B2, the first fabric layer facing the body and coupled to a first side of the first waterproof layer, the first waterproof layer and first fabric layer being formable about a human body and being constructed and arranged to accommodate one or more human appendages, and one or more waterproof seams for sealing joined edges of the first waterproof layer and first fabric layer.

2. Rainwear of claim 1, the polymer material comprising one of polyurethane, polytetrafluoroethylene, polyolefin and polyester.

3. Rainwear of claim 1, the polymer material being substantially hydrophobic.

4. Rainwear of claim 1, the polymer material being hydrophilic.

5. Rainwear of claim 1, the first waterproof layer absorbing less than 10% in water weight when fully saturated by water.

6. Rainwear of claim 1, the first waterproof layer resisting water penetration to at least 10 psi.

7. Rainwear of claim 1, the first fabric layer comprising one of a knitted fabric, a woven fabric, and a non-woven fabric.

8. Rainwear of claim 1, the first fabric layer comprising a bicomponent material.

9. Rainwear of claim 1, the first fabric layer comprising plaited knit.

10. Rainwear of claim 1, the first waterproof layer and the first fabric layer have a combined cross-sectional thickness of less than about 3 mm.

11. Rainwear of claim 1, further comprising an outer fabric layer coupled to a second side of the first waterproof layer for protecting the first waterproof layer and the first fabric layer.

12. Rainwear of claim 11, the outer fabric layer comprising one of a knitted fabric, a woven fabric, and a non-woven fabric.

13. Rainwear of claim 11, the outer fabric comprising one of nylon, polyester, acrylic, polypropylene, polyolefin and synthetic fiber material.

14. Rainwear of claim 1, further comprising a second waterproof layer having a first side coupled to a second side of the first waterproof layer, and a second fabric layer coupled to a second side of the second waterproof layer, the first and second waterproof layers and the first and second fabric layers being formable about a human body and being constructed and arranged to accommodate the one or more human appendages.

15. Rainwear of claim 14, the second waterproof layer being air permeable.

16. Rainwear of claim 14, the second waterproof layer comprising expanded polytetrafluoroethylene with a hydrophobic oleophobic treatment.

17. Rainwear of claim 14, the first and second waterproof layers and the first and second fabric layers having, in combination, a moisture vapor transmission rate (MVTR) greater than or equal to 3500 grams per square meter per day as measured by test method JIS-1099-B2.

18. Rainwear of claim 14, further comprising a first seam joining edges of the first waterproof layer and the first fabric layer, a second seam joining edges of the second waterproof layer with the second fabric layer, the seams being offset from one another to inhibit moisture passage through the rainwear at the seams.

* * * * *